US011236910B2

(12) United States Patent
Lee et al.

(10) Patent No.: US 11,236,910 B2
(45) Date of Patent: Feb. 1, 2022

(54) COOKING APPLIANCE

(71) Applicant: LG ELECTRONICS INC., Seoul (KR)

(72) Inventors: Kookhaeng Lee, Seoul (KR); Jun Ho Seok, Seoul (KR); Daebong Yang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 279 days.

(21) Appl. No.: 16/518,009

(22) Filed: Jul. 22, 2019

(65) Prior Publication Data

US 2020/0025390 A1 Jan. 23, 2020

(30) Foreign Application Priority Data

Jul. 23, 2018 (KR) ..... 10-2018-0085400

(51) Int. Cl.
*F24C 15/00* (2006.01)

(52) U.S. Cl.
CPC ..... *F24C 15/006* (2013.01)

(58) Field of Classification Search
CPC ..... F24C 15/006
See application file for complete search history.

(56) References Cited

U.S. PATENT DOCUMENTS

| | | | | |
|---|---|---|---|---|
| 2,158,881 | A * | 5/1939 | McCormick | F24C 15/2007 126/39 C |
| 2018/0003389 | A1* | 1/2018 | Trice | F24C 3/027 |
| 2018/0038596 | A1* | 2/2018 | Briscoe | F24C 15/001 |
| 2019/0260915 | A1* | 8/2019 | Armstrong | F27B 5/18 |

FOREIGN PATENT DOCUMENTS

| | | |
|---|---|---|
| DE | 3839657 | 5/1990 |
| EP | 0 701 094 | 3/1996 |
| EP | 1 640 666 | 3/2006 |
| EP | 2 072 903 | 6/2009 |
| JP | 11-211109 | 8/1999 |
| JP | 2007-225241 | 9/2007 |
| KR | 10-2004-0021906 | 3/2004 |
| KR | 10-0671570 | 1/2007 |

OTHER PUBLICATIONS

European Search Report dated Nov. 28, 2019.
Korean Notice of Allowance dated Jun. 2, 2020.

* cited by examiner

*Primary Examiner* — Jason Lau
(74) *Attorney, Agent, or Firm* — Ked & Associates LLP

(57) ABSTRACT

A cooking appliance is provided. The cooking appliance may include an oven having a cooking chamber therein; a cooktop disposed at an upper portion of the oven and provided with at least one cooktop heating unit; an exhaust vent disposed at a rear of the cooktop; an exhaust duct that forms a passage that connects the cooking chamber and the exhaust vent; a space formed between the oven and the at least one cooktop heating unit; a cool air-exhaust duct that forms a passage that connects the space and the exhaust vent; and a guide duct that forms a passage diverged from the cool air-exhaust duct and extended toward a rear of the exhaust duct.

10 Claims, 12 Drawing Sheets

COOKING APPLIANCE

CROSS-REFERENCE TO RELATED APPLICATION(S)

This application claims priority to and the benefit of Korean Patent Application No. 10-2018-0085400, filed in Korea on Jul. 23, 2018, the disclosure of which is incorporated herein by reference in its entirety.

BACKGROUND

1. Field

A cooking appliance, and more specifically, a cooking appliance used to cook food items is disclosed herein.

2. Background

A cooking appliance is an appliance that is placed in the kitchen and that cooks food items according to a user's intention. Cooking appliances may be classified into various sorts of appliances on the basis of the sort of heat sources, types and fuels.

When it comes to the way of cooking foods, cooking appliances may be classified into opened type cooking appliances and closed type cooking appliances depending on whether a space in which food items are placed is opened or closed. The closed type cooking appliances include ovens, microwave ovens and the like, and the opened type cooking appliances include cooktops, hobs, griddles and the like.

The closed type cooking appliances shield a space in which foods are placed and heat the shielded space to cook foods. The closed type cooking appliances are provided with a cooking chamber that is a space in which foods are placed and which is shielded when foods are cooked. The cooking chamber is substantially a space for cooking foods.

Additionally, the closed type cooking appliances are provided with a swivel-mounted door that optionally opens and closes the cooking chamber. The door is swivel-mounted in a main body that has the cooking chamber therein by a door hinge provided between the main body and the door, and swivels around a portion in which the door and the main body are coupled through the door hinge to optionally open and close the cooking chamber.

The inner space of the cooking chamber, which is opened and closed by the door, is provided with a heat source to heat the cooking chamber. The heat source may include a gas burner, an electric heater and the like.

Further, the closed type cooking appliances are provided with an exhaust duct. The exhaust duct is provided to discharge combustion gases that are generated while food items are being cooked in the cooking chamber out of the cooking appliance.

The lower end portion of the exhaust duct is connected to the upper portion of the cooking chamber, and the upper end portion of the exhaust duct is disposed in the upper portion of the rear surface of the cooking appliances. The combustion gases, generated in the cooking chamber, are introduced into the exhaust duct connected to the upper portion of the cooking chamber and flows upward, and is discharged through an exhaust vent placed in the upper portion of the exhaust duct upward from the rear surface of the cooking appliance.

The combustion gases discharged out of the cooking appliance through the exhaust duct and exhaust vent usually have high temperatures. Additionally, the upper end portion and peripheral portion of the exhaust duct provided to discharge the combustion gases are disposed very close to a rear panel that forms an appearance of the cooking appliance at the rear surface of the cooking appliance, to be placed close to the rear surface of the cooking appliance as much as possible.

Accordingly, a higher temperature of the combustion gases discharged through the exhaust duct increases the risk of a fire that may be caused due to the overheating of the rear panel adjacent to the exhaust duct, and a burn of a user, which may be caused by an overheated rear panel and high temperatures of combustion gases discharged through the exhaust duct.

BRIEF DESCRIPTION OF THE DRAWINGS

Embodiments will be described in detail with reference to the following drawings in which like reference numerals refer to like elements, and wherein.

DETAILED DESCRIPTION

Figure 1:
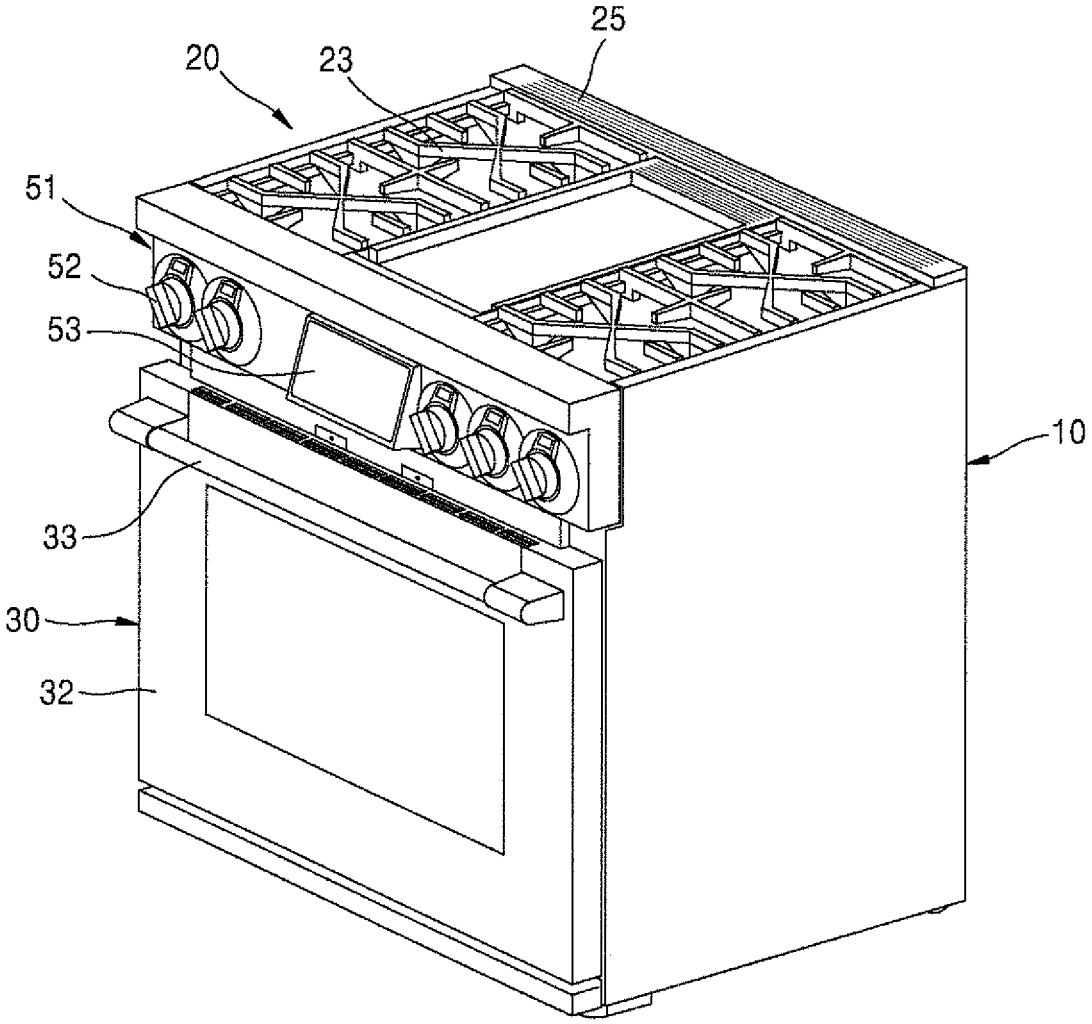
FIG. 1 is a perspective view illustrating a cooking appliance according to an embodiment.

Below, embodiments of the cooking appliance according to the present disclosure are described with reference to the attached drawings. During description of the embodiments, the thickness of lines or the size of the elements illustrated in the drawings may be exaggerated for the sake of convenience and clarity in description. Further, the terms that are described hereunder are those defined considering the functions described in the present invention and may differ depending on the intention or the practice of the user or operator. Therefore, such terms should be defined on the basis of what is described throughout the specification.

[Entire Structure of Cooking Appliance]

Figure 2:
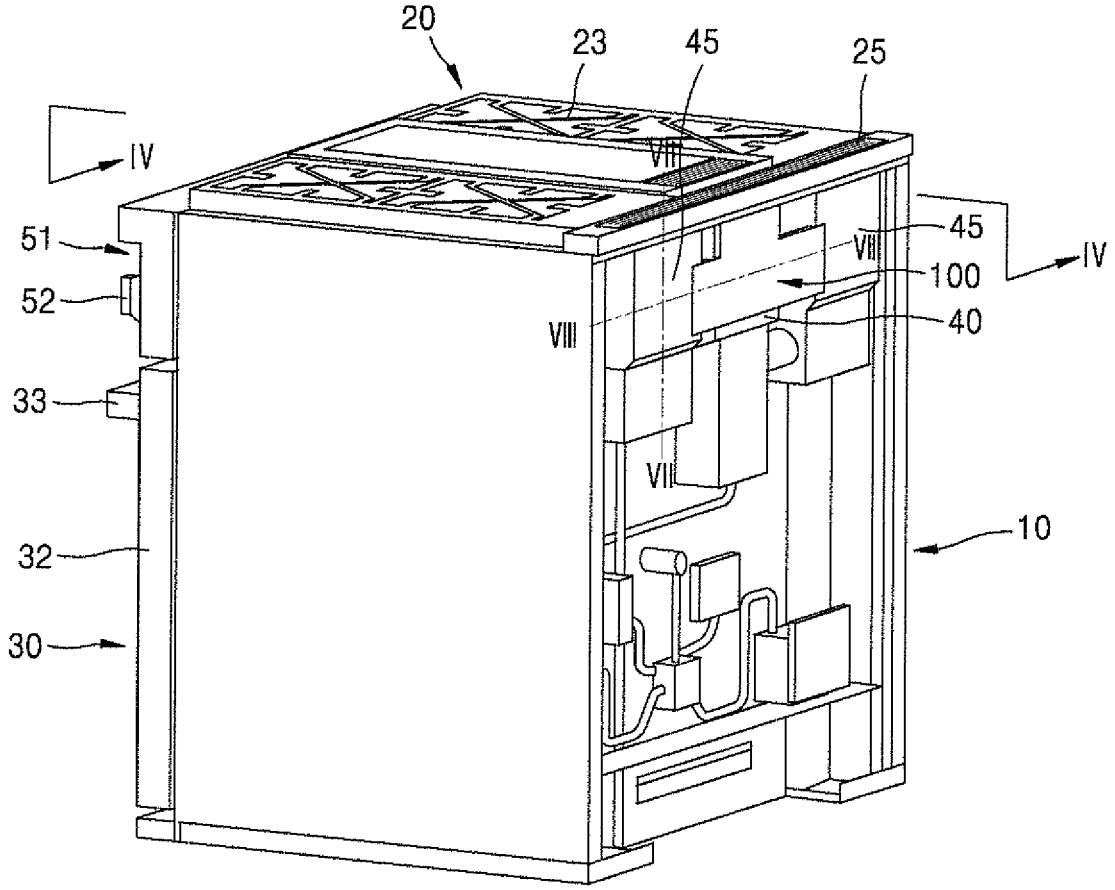
FIG. 2 is a rear perspective view illustrating a rear surface of the cooking appliance in FIG. 1.
Figure 3:
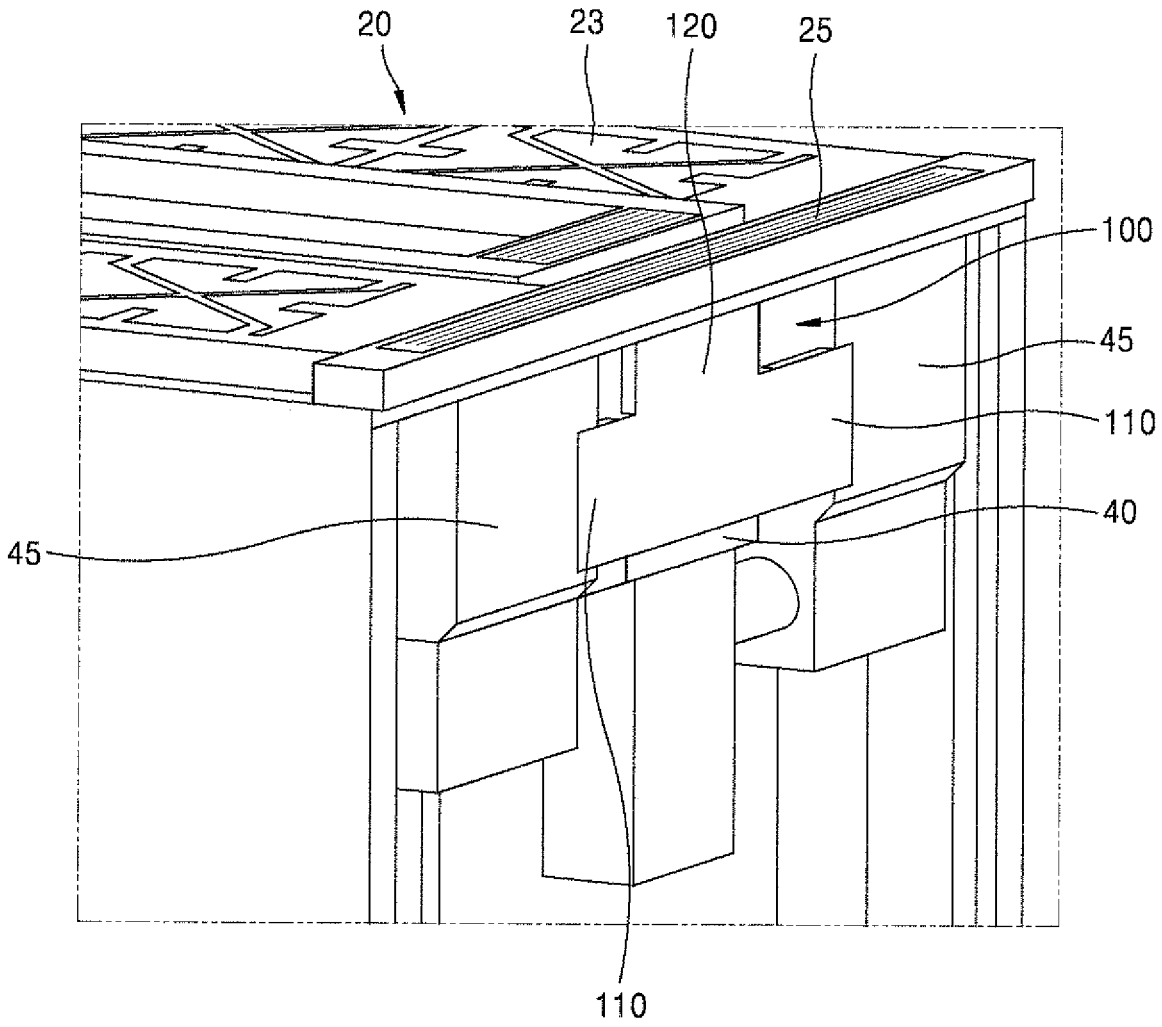
FIG. 3 is an enlarged view illustrating a portion of the cooking appliance in FIG. 2.
Figure 4:
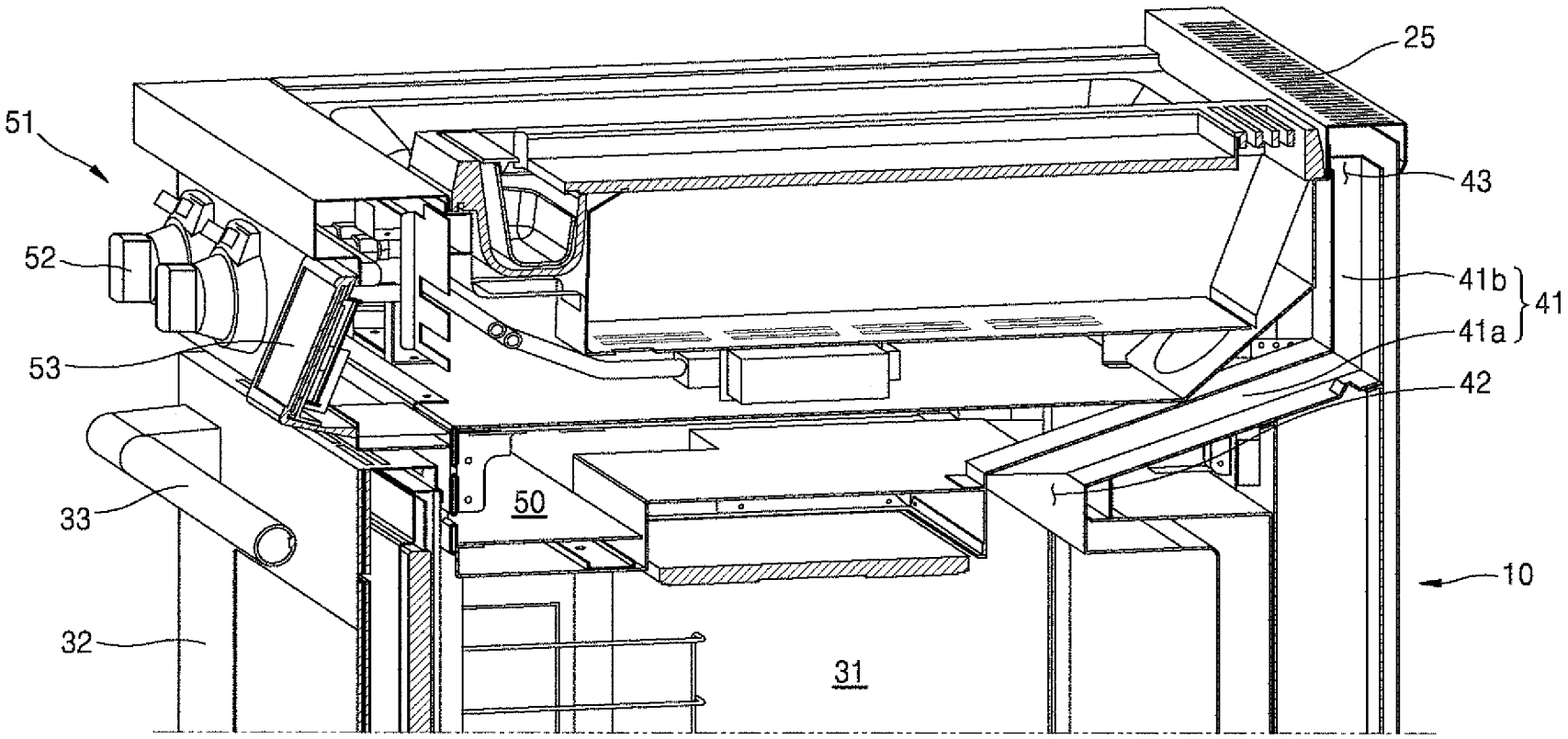
FIG. 4 is a sectional view, taken along line "IV-IV" in FIG. 2.

FIG. 1 is a perspective view illustrating a cooking appliance according to an embodiment, FIG. 2 is a rear perspective view illustrating a rear surface of the cooking appliance in FIG. 1, FIG. 3 is an enlarged view illustrating a portion of the cooking appliance in FIG. 2, and FIG. 4 is a sectional view along the line "IV-IV" in FIG. 2.

Referring to FIGS. 1 to 4, the appearance of a cooking appliance according to an embodiment is formed by a main body 10. The main body 10 may have a shape including an approximately rectangular cuboid and may include a material having a predetermined strength to protect a plurality of parts therein. The main body 10 may include a rear panel 15 defining a rear surface of the cooking appliance.

The main body 10 is provided with an open space, i.e., a cooktop unit 20 that cooks food by heating the food placed on the upper side of the main body, or a container containing the food, in the upper end portion thereof.

At least one or more of cooktop heating units 23 are placed in the cooktop unit 20 to heat food items subject to cooking or a container that contains food items.

Additionally, an oven unit 30 is installed on the lower side of the cooktop unit 20. A cooking chamber 31 that provides a space for cooking food items is placed inside the oven unit 30.

The cooking chamber 31 has the shape of a cuboid the front surface of which is opened, and food items are cooked by heating the inner space of the cooking chamber 31 with the cooking chamber 31 being shielded. That is, in the oven unit 30, the inner space of the cooking chamber 31 is a space in which food items are substantially cooked.

A burner in the form of a broil burner that heats the inner space of the cooking chamber 31 from above may be placed on the upper side of the cooking chamber 31, and a burner in the form of a baker burner that heats the inner space of the cooking chamber 31 from below may be further placed on the lower side of the cooking chamber 31.

Additionally, a convection unit that heats the inner space of the cooking chamber 31 through convection of hot air may be further provided on the rear side of the cooking chamber 31.

The convection unit forces air inside the cooking chamber 31 to flow. That is, the convection unit suctions and heats air inside the cooking chamber 31, and then allows the air to flow while discharging the air into the inner space of the cooking chamber 31, and heats the inner space of the cooking chamber 31, thereby evenly heating food items inside the cooking chamber 31.

A door 32 that optionally opens and closes the cooking chamber 31 is swivel mounted to the oven unit 30. The door 32 may open and close the cooking chamber 31 in the pull-down manner in which the upper end of the door swivels vertically with respect to the lower end of the door.

The door 32 has the shape of a cuboid having a predetermined thickness as a whole, and a handle 33 is installed at the front of the door such that a user may grip the handle when the user wants to swivel the door 32. The user may readily swivel the door 32 using the handle 33.

A control panel 51 is provided at the front surface of the cooktop unit 20, i.e., on the upper side of the door 32. The control panel 51 may have the shape of a cuboid that has a predetermined inner space. Additionally, an input unit 52 is provided at the front surface of the control panel 51 such that the user may input operating signals to operate the cooktop unit 20 and the oven unit 30.

A plurality of operating switches are provided to the input unit 52. Accordingly, the user may directly input operating signals. In this case, the operating switches may be provided in the form of a knob that may be operated by a rotation or may be provided in the form of a button or a panel that may be operated by a press or by a touch.

Additionally, a display part 53 that provides information on operation of the cooking appliance or information on cooking food items and the like may be further provided to the control panel 51. The user may check various sorts of information on the cooking appliance through the display unit 53.

An electric chamber 50 in which electric parts are placed is formed in the inner space of the main body 10, i.e., a space between the cooktop heating unit 23 and the oven unit 30.

The electric chamber 50 may be a space that is formed between the cooktop unit 20 and the oven unit 30 and may be a space in which a space between the cooktop unit 20 and the oven unit 30 is combined with the inner space of the cooktop unit 20. The front surface of the electric chamber 50 may be shielded by the control panel 51, and as illustrated in the embodiment, may be shielded by the door 32.

[Exhaust and Cooling Structure of Cooking Appliance]

Figure 5:
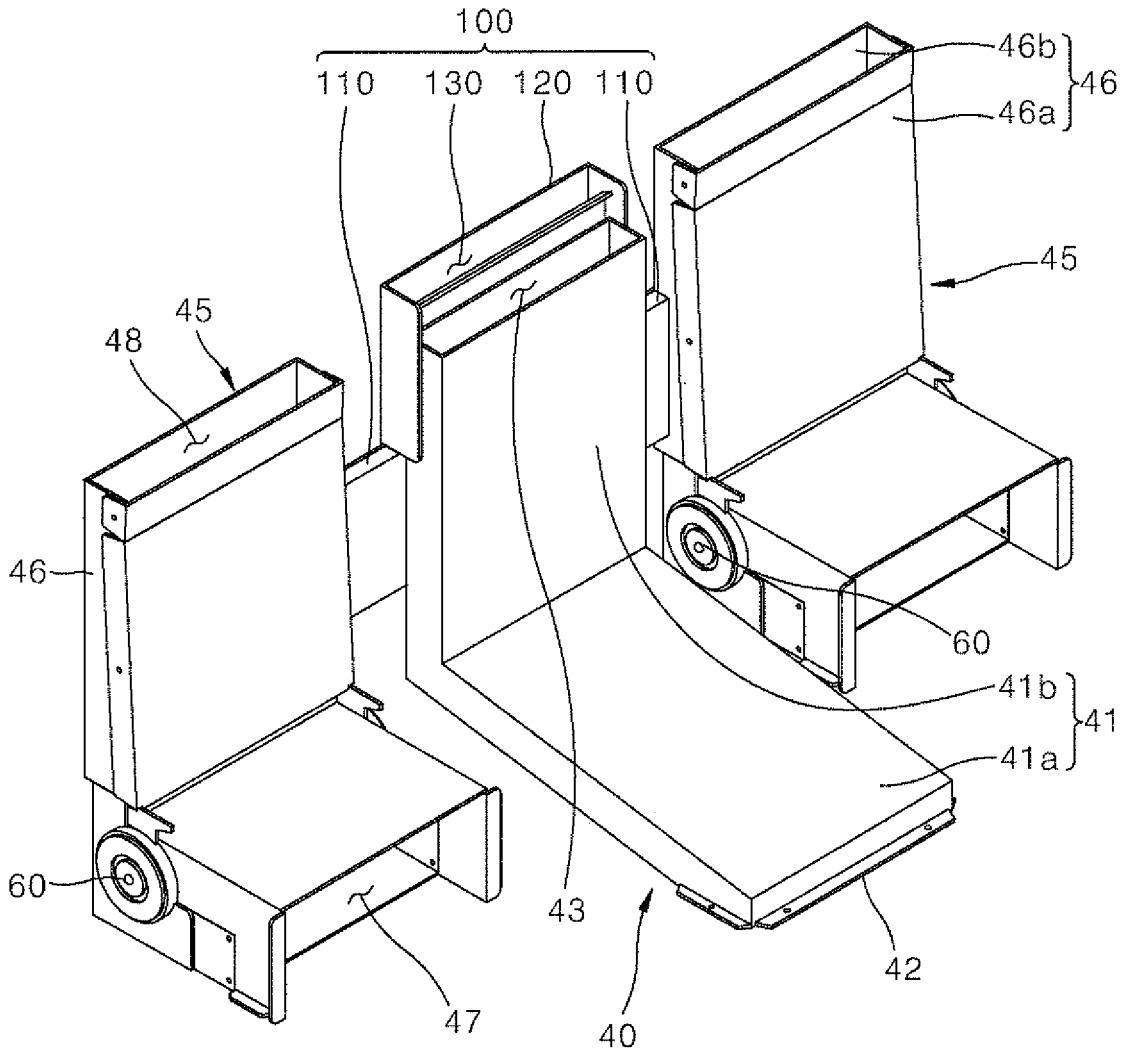
FIG. 5 is a view illustrating a separated portion of the cooking appliance in FIG. 2.
Figure 6:
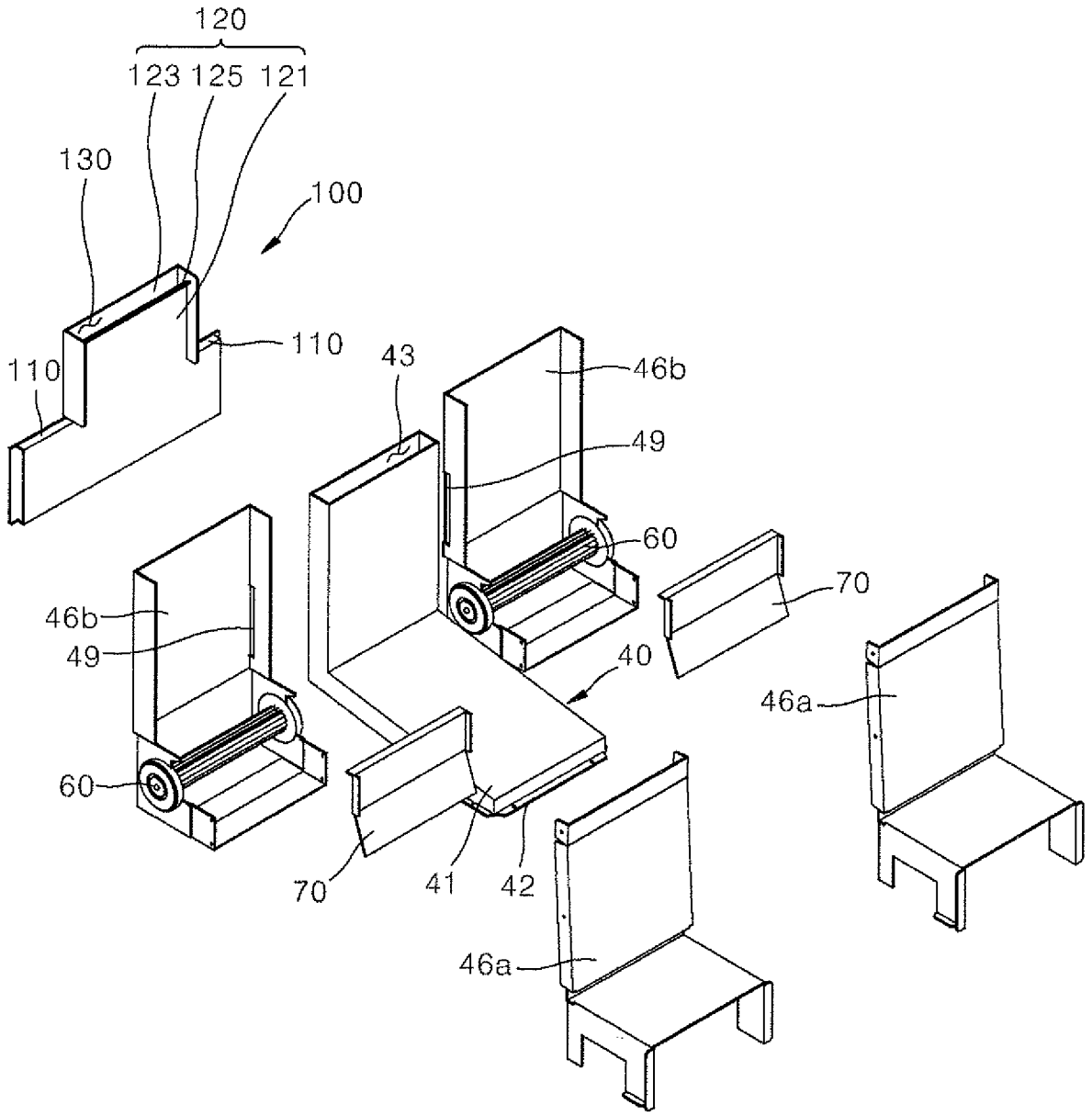
FIG. 6 is an exploded perspective view illustrating a separated portion of the cooking appliance in FIG. 5.

FIG. 4 is a sectional view along the line "IV-IV" in FIG. 2, FIG. 5 is a view illustrating a separated portion of the cooking appliance in FIG. 2, and FIG. 6 is an exploded perspective view illustrating a separated portion of the cooking appliance in FIG. 5.

Referring to FIGS. 3 and 4, an exhaust duct 40 may be provided in the upper portion of the cooking chamber 31, and an exhaust vent 25 may be provided at the rear of the upper portion of the cooking apparatus.

The exhaust duct 40 connects the inside of the cooking chamber 31 and the exhaust vent 25 in the upper portion of the cooking chamber 31. A flow path that guides high-temperature combustion gases generated in the cooking chamber 31 such that the high-temperature combustion gases may flow toward the exhaust vent 25 is formed inside the exhaust duct 40.

The exhaust duct 40, as illustrated in FIGS. 3 to 6, may include a first duct body 41, a first inlet 42, and a first exhaust opening 43.

The first duct body 41 forms a passage that connects the cooking chamber 31 and the exhaust vent 25, therein. The first duct body 41 may be divided into the lower section 41*a* that is disposed in the electric chamber 50, and the upper section 41*b* that is connected with the exhaust vent 25.

The first inlet 42 is formed at the lower end of the lower section 41*a*. The first inlet 42 forms a passage that is connected with the cooking chamber 31 of the oven unit 30 at one end of the first duct body 41, i.e., the end of the lower section 41*a*. The lower section 41*a* is inclined backward and upward inside the electric chamber 50, and the upper end of the lower section 41*a* is connected with the upper section 41*b*.

The upper section 41*b* is disposed near the rear surface of the cooking appliance. The upper section 41*b* passes through the rear area of the cooktop unit 20 and extends upward. The upper section 41*b* forms a passage that connects the lower section 41*a* and the exhaust vent 25, therein. The lower end of the upper section 41*b* is connected with the upper end of the lower section 41*a*, and the first exhaust opening 43 is formed at the upper end of the upper section 41*b*.

The first exhaust opening 43 forms a passage that opens the other end of the first duct body 41 at the upper end of the upper section. The first exhaust opening 43 is disposed in the lower portion of the exhaust vent 25 to adjoin the exhaust vent 25. The combustion gases of the cooking chamber 31, which are introduced into the first duct body 41 through the first inlet 42, may escape from the first duct body 41 through the first exhaust opening 43 and may come out of the cooking appliance through the exhaust vent 25.

The exhaust vent 25 is provided at the rear of the cooktop unit 20 in the upper portion of the cooking appliance. High-temperature combustion gases that move toward the exhaust vent 25 through the exhaust duct 40, and air that is discharged through a below-described cool air-exhaust duct 45 may be discharged out of the cooking appliance through the exhaust vent 25.

A space is formed between the oven unit 30 and the cooktop heating unit 23 in the upper portion of the oven unit 30. In the embodiment, the electric chamber 50 exemplifies the space.

A cool air passage may be formed between the door 32 in the lower portion of the cooking appliance, and the control panel 51 in the upper portion of the cooking appliance. The cool air passage is a passage that is formed in the way that a gap between the door 32 and the control panel 51 communicates with the electric chamber 50.

Through the cool air passage that is formed as described above, air outside the cooking appliance may be introduced from the front of the cooking appliance into the electric chamber 50. The air that is introduced into the electric chamber 50 through the cool air passage cools the inside of the electric chamber 50 and comes out of the cooking appliance through the exhaust vent 25.

The electric chamber 50 is provided with a cool air-exhaust duct 45. The cool air-exhaust duct 45 is provided to form air currents in which cool air is introduced into the electric chamber 50 through the cool air passage, and the introduced air comes out of the cooking appliance again through the exhaust vent 25. The cool air-exhaust duct 45, as illustrated in FIGS. 4 to 6, may include a second duct body 46, a second inlet 47, and a diverging opening 49.

The second duct body 46 is formed in the inside that connects between the electric chamber 50 and the exhaust vent 25.

The second duct body 46 may be divided into the lower section that is disposed in the electric chamber 50, and the upper section that is connected with the exhaust vent 25.

The second inlet 47 is formed in the lower section. The second inlet 47 forms a passage that opens one end of the second duct body 46 toward the front of the electric chamber 50, in the front end portion of the lower section thereof.

The upper section is disposed near the rear surface of the cooking appliance. The upper section passes through the rear area of the cooktop unit 20 and extends upward. The lower end of the upper section is connected with the upper end of the lower section, and a second exhaust opening 48 is formed at the upper end of the upper section.

The second exhaust opening 48 forms a passage that opens the other end of the second duct body 46 at the upper end of the upper section. The second exhaust opening 48 is disposed in the lower portion of the exhaust vent 25 to adjoin the exhaust vent 25. Air of the electric chamber 50, which is introduced into the second duct body 46 through the second inlet 47, may escape from the second duct body 46 through the second exhaust opening 48 and may come out of the cooking appliance through the exhaust vent 25.

The diverging opening 49 forms a passage that opens the second duct body 46 at a position different from that of the second inlet 47 and the second exhaust opening 48. The diverging opening 49 is disposed between the second inlet 47 and the second exhaust opening 48 and forms a passage that opens the second duct body 46 laterally.

The diverging opening 49 is formed to laterally penetrate on a lateral surface of the second duct body 46 that faces the exhaust duct 40 disposed in a lateral portion of the cool air-exhaust duct 45. The diverging opening 49 forms a passage that opens a lateral surface of the second duct body 46 between the second inlet 47 and the second exhaust opening 48 in a lateral direction facing the exhaust duct 40.

According to the embodiment, a pair of cool air-exhaust ducts 45 are laterally disposed on the rear surface of the cooking appliance and spaced a predetermined distance apart from each other with the exhaust duct 40 therebetween. That is, the pair of cool air-exhaust ducts 45 and the exhaust duct 40 are laterally disposed on the rear surface of the cooking appliance in the order of cool air-exhaust duct 45-exhaust duct 40-cool air-exhaust duct 45.

Combustion gas inside the cooking chamber 31 is discharged through the exhaust duct 40 placed between the pair of cool air-exhaust ducts 45. Air that is introduced through the front of the cooking appliance and that passes through the electric chamber 50 is discharged through the pair of cool air-exhaust ducts 45 disposed respectively on both sides of the exhaust duct 40.

Additionally, the cooking appliance of the embodiment may further include a blowing unit 60. The blowing unit 60 forms air currents in which air introduced into the electric chamber 50 is discharged out of the exhaust vent 25 through the cool air-exhaust duct 45.

The blowing unit 60 may include a fan that is provided on the second inlet 47 side. The blowing unit 60 suctions air introduced into the electric chamber 50 through the cool air passage at the front of the cooking appliance, and introduces the air into the cool air-exhaust duct 45. As described above, the air introduced into the cool air-exhaust duct 45 may be discharged out of the exhaust vent 25 through the second exhaust opening 48 or may be discharged out of a lateral portion of the cool air-exhaust duct 45 through the diverging opening 49.

[Structures of Bypass Member and Guide Duct]

The cooking appliance of the embodiment may further include a bypass member 70 and a guide duct 100. The bypass member 70 is placed inside the second duct body 46 of the cool air-exhaust duct 45. The bypass member 70 forms a passage, which directs airflow introduced into the second duct body 46 toward the diverging opening 49, inside the second duct body 46.

According to the embodiment, the second inlet 47 and the second exhaust opening 48 are respectively disposed in the lower and upper portions of the second duct body 46. The diverging opening 49 is disposed in a lateral portion of the second duct body 46 while disposed in a lateral portion that faces the second duct body 46 of another adjacent cool air-exhaust duct 45. The bypass member 70 forms a passage the lower portion of which is opened toward the second inlet 47 and the lateral portion of which is opened toward the diverging opening 49, therein.

As an example, the bypass member 70 may have the shape of a box the lateral portion and lower portion of which are opened. A lateral portion of the bypass member 70 may be coupled to the inner surface of the second duct body 46, and the rear of the bypass member 70 may be may be installed inside the second duct body 46 in the way that the rear is encircled by the rear surface of the second duct body 46 or coupled to the second duct body 46.

Accordingly, a space the upper portion and rear portion of which are blocked by the bypass member 70 and the lateral portion of which is blocked by a lateral surface of the second duct body 46 is formed inside the bypass member 70. Additionally, the lower portion of the space may be opened toward the inside the second duct body 46, and the one lateral portion of the space may be connected with the diverging opening 49.

Preferably, the bypass member 70 may have a shape in which the width of the lower portion of the bypass member 70 becomes wider as the bypass member 70 is closer to the second inlet 47. In the embodiment, as an example, a predetermined lower area of the bypass member 70 is inclined while the predetermined lower area is inclined closer to the lower portion thereof in a direction away from the rear surface of the second duct body 46.

The bypass member 70, formed as described above, may effectively direct the air flow that is introduced through the second inlet 47 toward the inside of the bypass member 70. By doing so, when air that is introduced through the second inlet 47 is discharged out of a lateral portion of the cool air-exhaust duct 45 through the diverging opening 49 rather than through the second exhaust opening 48, an amount of the air discharged out of a lateral portion of the cool air-exhaust duct 45 through the diverging opening 49 is greater than that of the air discharged through the second exhaust opening 48.

The second duct body 46 may have a structure in which two members are coupled to form a single second duct body 46. Accordingly, the second duct body 46 may be separated into a front member 46*a* and a rear member 46*b*, and the front member 46*a* and rear member 46*b* may be coupled to each other to form a single second duct body 46.

With the structure of the second duct body 46, the blowing unit 60 and the bypass member 70 may be readily installed.

That is, in the state in which the second duct body 46 is separated into the front member 46*a* and rear member 46*b*, the blowing unit 60 and the bypass member 70 are installed in each or any one of the rear member 46*b* and front member 46*a*, and after the installation is completed, the front member 46*a* and rear member 46*b* are coupled. Thus, the blowing unit 60 and the bypass member 70 may be installed, and the second duct body 46 may be assembled.

Figure 7:
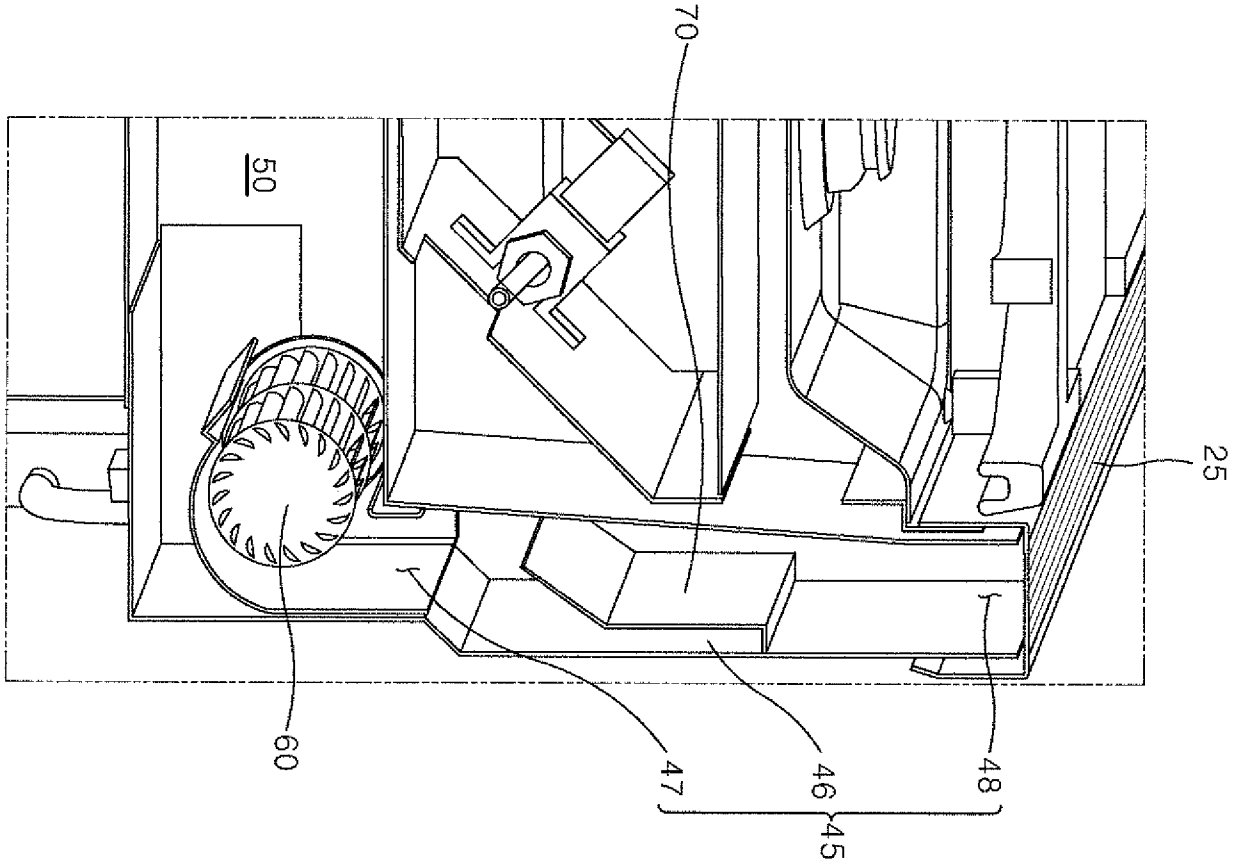
FIG. 7 is a sectional view, taken along line "VII-VII" in FIG. 2.
Figure 8:
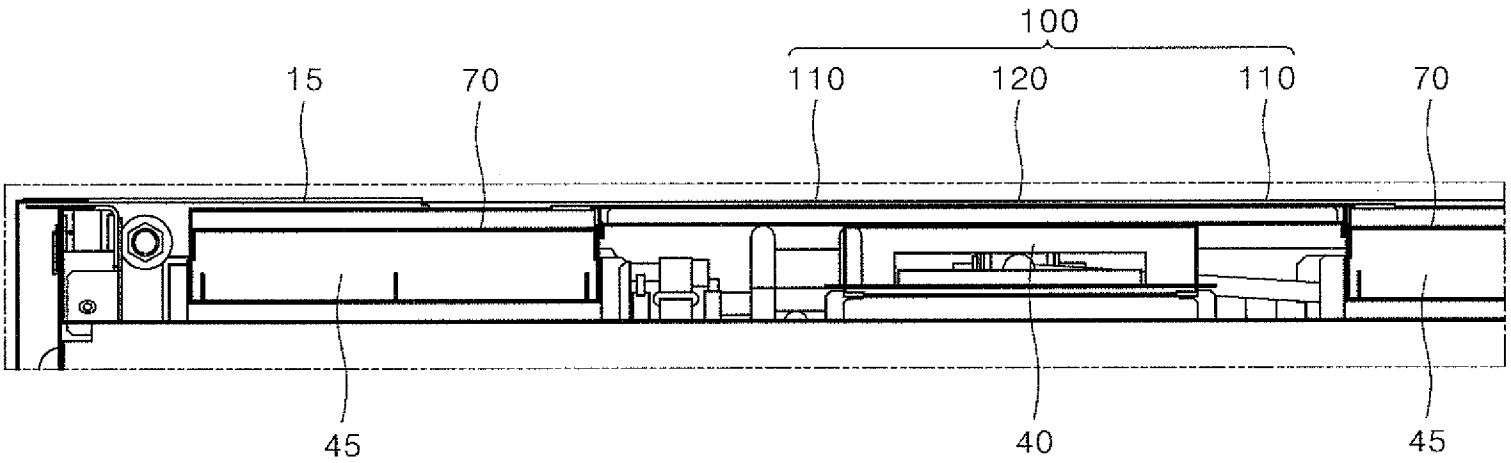
FIG. 8 is a sectional view, taken along line "VIII-VIII" in FIG. 2.

FIG. 7 is a sectional view along the line "VII-VII" in FIG. 2, and FIG. 8 is a sectional view along the line "VIII-VIII" in FIG. 2.

Referring to FIGS. 4 to 8, the guide duct 100 forms a passage that is diverged from the cool air-exhaust duct 45 and extended toward the first exhaust opening 43 of the exhaust duct 40, therein. The guide duct 100 directs the flow of air that is diverged from the cool air-exhaust duct 45, i.e., the flow of air that is discharged through the diverging opening 49, toward the exhaust duct 40. According to the embodiment, the guide duct 100 includes a first duct unit 110, a second duct unit 120, and a third exhaust opening 130.

The first duct unit 110 is disposed between the cool air-exhaust duct 45 and the exhaust duct 40. Specifically, the first duct unit 110 is provided between the exhaust duct 40 and the cool air-exhaust duct 45 and forms a passage that connects the diverging opening 49 and a below-described second duct unit 120, therein.

The first duct unit 110 forms a passage that directs the flow of air discharged through the diverging opening 49 toward the exhaust duct 40, therein. In the embodiment, as an example, the first duct unit 110 is extended laterally between the cool air-exhaust duct 45 and the exhaust duct 40 and is provided in the form of a duct with both left and right sides that are opened.

The second duct unit 120 is disposed at the rear of the exhaust duct 40. Specifically, the second duct unit 120 is provided at the rear of the exhaust duct 40, and forms a passage that connects the first duct unit 110 and the first exhaust opening 43 at the rear of the exhaust duct 40, therein.

The second duct unit 120 forms a passage that directs air flowing into first duct unit 110 such that the air is discharged from the rear of the exhaust duct 40 adjacent to the first exhaust opening 43, therein. In the embodiment, as an example, the second duct unit 120 is provided in the form of a duct that is extended upward and downward like the exhaust duct 40. Both sides of the lower portion of the second duct unit 120 are connected with the first duct units 110, and the third exhaust opening 130 is formed in the upper portion of the second duct unit 120.

The second duct unit 120 is disposed at the rear of the exhaust duct 40 while disposed at the rear of the upper section 41*b*. The second duct unit 120 may be installed in the way that contacts the upper section 41*b* at the rear of the upper section 41*b*. Heat exchange between the second duct unit 120 and upper section 41*b* in contact with each other may occur. That is, heat exchange between low-temperature air flowing inside the second duct unit 120 and high-temperature combustion gases flowing in the upper section 41*b* of the exhaust duct 40 may occur. Additionally, the discharge temperature of the combustion gases, discharged through the exhaust duct 40, may be dropped by the heat exchange that occurs as described above.

The third exhaust opening 130 opens the second duct unit 120 toward the exhaust vent 25 in a position adjacent to the first exhaust opening 43. That is, the third exhaust opening 130 is formed to penetrate upward and downward at the upper end of the second duct unit 120 and forms a passage that opens the second duct unit 120 toward the exhaust vent 25 at the upper end of the second duct unit 120.

According to the embodiment, a pair of the cool air-exhaust ducts 45 are disposed on both sides of the exhaust duct 40 and spaced a predetermined distance apart from each other with the exhaust duct 40 therebetween, on the rear surface of the cooking appliance.

Accordingly, the guide duct 100 is formed in the way that a pair of the first duct units 110 are disposed on both sides of the second duct unit 120 with the second duct unit 120 therebetween. As an example, the guide duct 100 may be provided in the shape of "凸", in which the second duct unit 120 between the first duct units 110 is connected with the first duct units 110 on both sides of the second duct unit 120.

A rear panel 15 is provided at the rear of the exhaust duct 40 and the guide duct 100. The rear panel 15 is connected to the rear of the oven unit 30 and the cooktop unit 20 and forms the rear appearance of the cooking appliance. In this case, the rear panel 15 may be provided only to form the rear appearance of the cooking appliance, or may be provided to form the rear and lateral appearances of the cooking appliance by being connected with the rear and both lateral portions of the oven unit 30 and the cooktop unit 20.

In the guide duct 100, the first duct units 110 in both lateral portions of the guide duct 100 are disposed to face a lateral portion of the cool air-exhaust duct 45, and the second duct unit 120 between the first duct units 110 is disposed at the rear of the exhaust duct 40. In this case, the second duct unit 120 is provided at the rear of the exhaust duct 40 such that the third exhaust opening 130 is disposed between the first exhaust opening 43 and the rear panel 15. Additionally, the second duct unit 120 is provided such that the third exhaust opening 130 is disposed higher than the first exhaust opening 43. Detailed description in relation to this is provided below.

[Operation and Effect of Bypass Member and Guide Duct]

FIGS. 9 to 12 are views illustrating flow of cool air in the cooking appliance according to an embodiment.

Below, the operation and effect of the bypass member and the guide duct of the embodiment are described with reference to FIG. 4 and FIGS. 8 to 12.

When fuels of the burner or the convection unit in the cooking chamber 31 are combusted, as illustrated in FIG. 4, the inside of the cooking chamber 31 is heated and food is cooked in the cooking chamber 31.

Combustion gases, which are generated during the process of cooking food items inside the cooking chamber 31, are conveyed out of the cooking chamber 31 through the exhaust duct 40 and then is discharged out of the cooking appliance through the exhaust vent 25.

Figure 9:
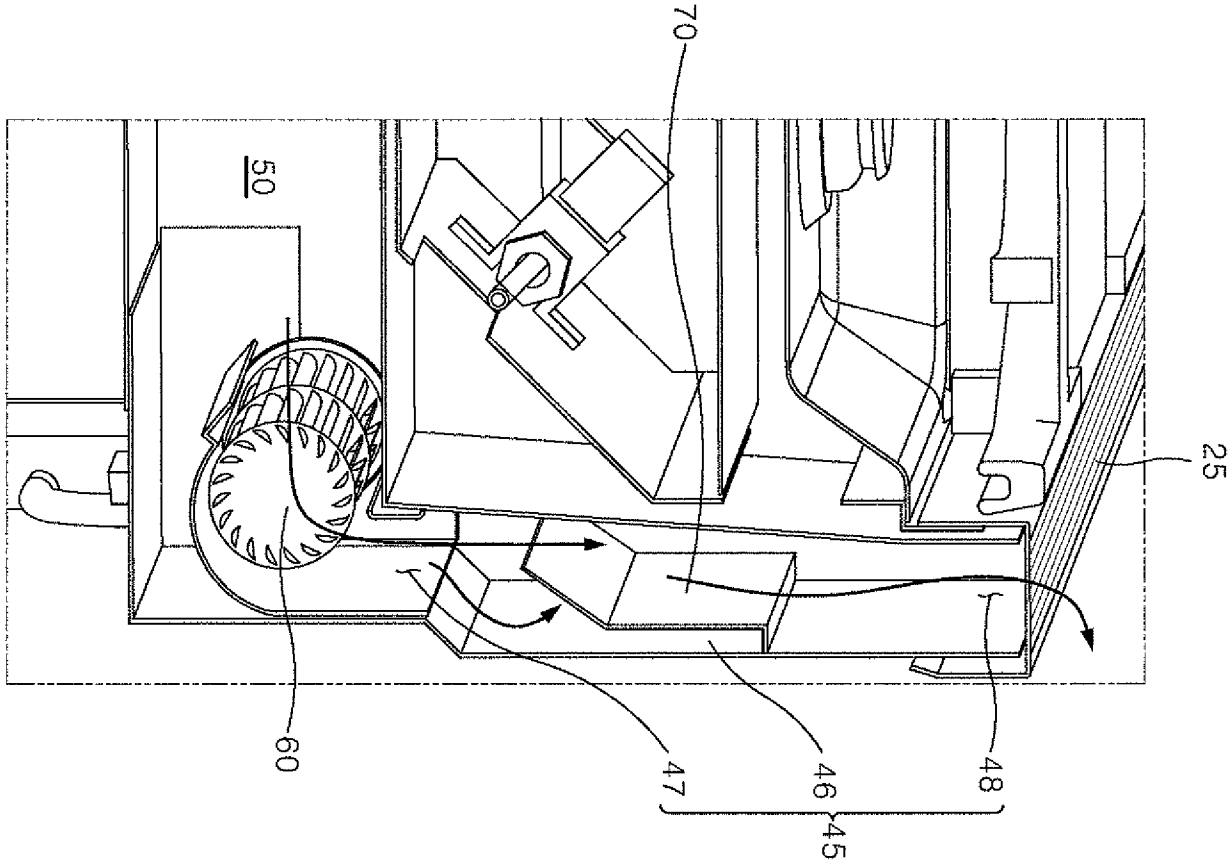
FIGS. 9 to 12 are views illustrating flow of cool air in the cooking appliance according to an embodiment.

Along with this, cool air is introduced into the electric chamber 50 through the cool air passage. The air introduced into the electric chamber 50, as illustrated in FIGS. 4 and 9, is discharged out of the electric chamber 50 through the cool air-exhaust duct 45.

The inflow of cool air to the electric chamber 50, and the outflow of the cool air through the cool air-exhaust duct 45 may be facilitated by operation of the blowing unit 60 in the electric chamber 50.

The blowing unit 60 generates air currents that allow external air to flow into the electric chamber 50 through the cool air passage at the front of the cooking appliance. The air introduced into the electric chamber 50 is suctioned into the blowing unit 60 while cooling electric parts in the electric chamber 50, and is introduced into the cool air-exhaust duct 45 through the second inlet 47.

In this case, temperature of the air introduced into the cool air-exhaust duct 45 rises slightly while passing through the electric chamber 50, but is much lower than that of the combustion gases that are discharged through the exhaust duct 40.

Some of the air introduced into the cool air-exhaust duct 45 passes through a flow path inside the cool air-exhaust duct 45 upward and comes out of the cooking appliance by passing through the second exhaust opening 48 and the exhaust vent 25.

Figure 10:
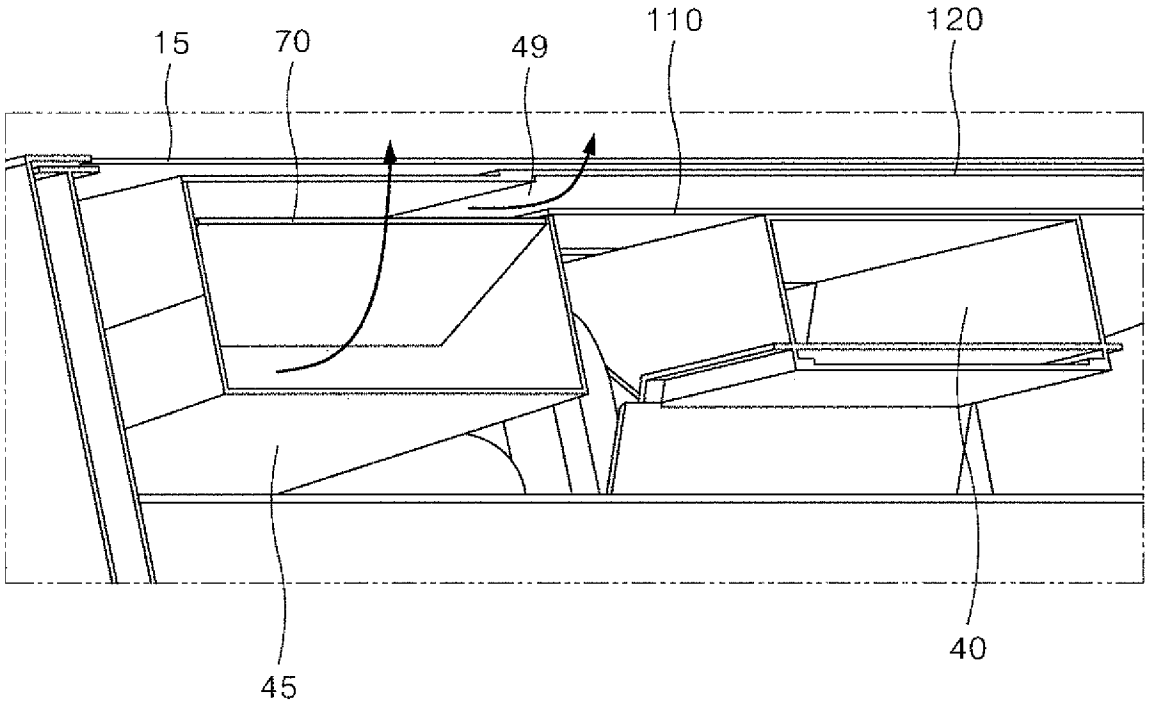

Additionally, the other part of the air introduced into the cool air-exhaust duct 45, as illustrated in FIGS. 9 and 10, is introduced into the bypass member 70, and then is introduced into the guide duct 100, specifically, the first duct unit 110 through the diverging opening 49.

Figure 11:
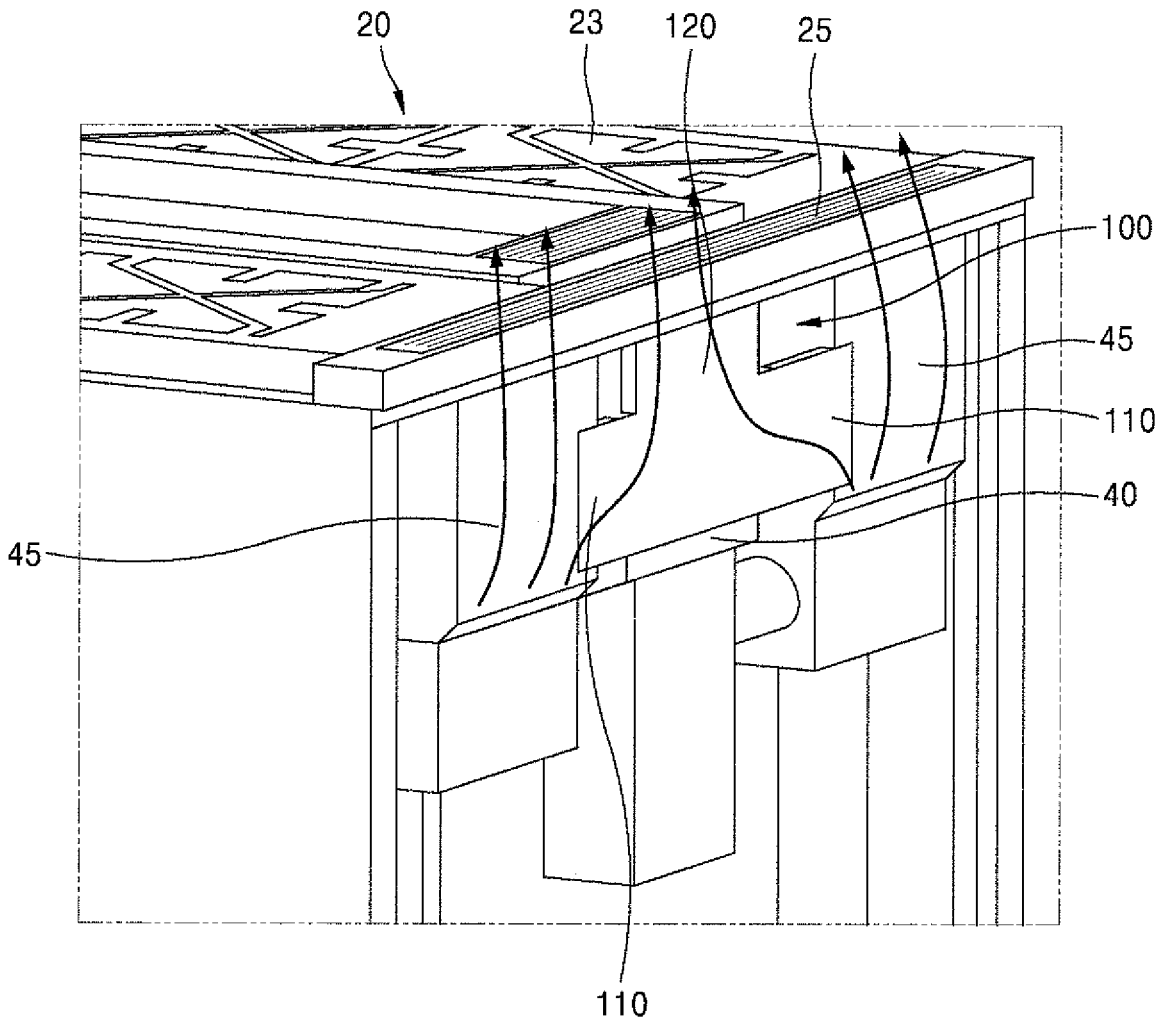

The air introduced into the first duct unit 110, as illustrated in FIGS. 10 and 11, is introduced into the second duct unit 120 connected with the first duct unit 110, and moves along a flow path inside the second duct unit 120.

According to the embodiment, the second duct unit 120 may be installed in the way that contacts the upper section (b; see FIG. 4) of the exhaust duct 40. Accordingly, heat exchange between low-temperature air moving through the second duct unit 120 and high-temperature combustion gases moving along the exhaust duct 40 may occur. The discharge temperature of combustion gases, discharged through the exhaust duct 40, may be dropped by the heat exchange that occurs as described above.

The second duct unit 120 guides the flow of air such that the air introduced into the guide duct 100 is discharged from a position adjacent to the first exhaust opening 43 at the rear of the exhaust duct 40.

To this end, the third exhaust opening 130 of the second duct unit 120 is disposed at the rear adjacent to the first exhaust opening 43 of the exhaust duct 40. Accordingly, the high-temperature combustion gases as well as the low-temperature air (hereinafter referred to as "cool air") are discharged from the central area of the rear of the upper portion of the cooking appliance, through the first exhaust opening 43 and the third exhaust opening 130 respectively.

In this case, as illustrated in FIG. 11, the third exhaust opening 130 is disposed in a position more adjacent to the rear panel 15 at the rear surface of the cooking appliance than the first exhaust opening 43. Accordingly, cool air is discharged from a position more adjacent to the position where high-temperature combustion gases are discharged.

By doing so, an air curtain is formed by the cool air such that the high-temperature combustion gases do not directly contact the rear panel 15 at the rear surface of the cooking appliance. Accordingly, the rear panel 15 at the rear surface of the cooking appliance may be effectively prevented from being overheated.

Figure 12:
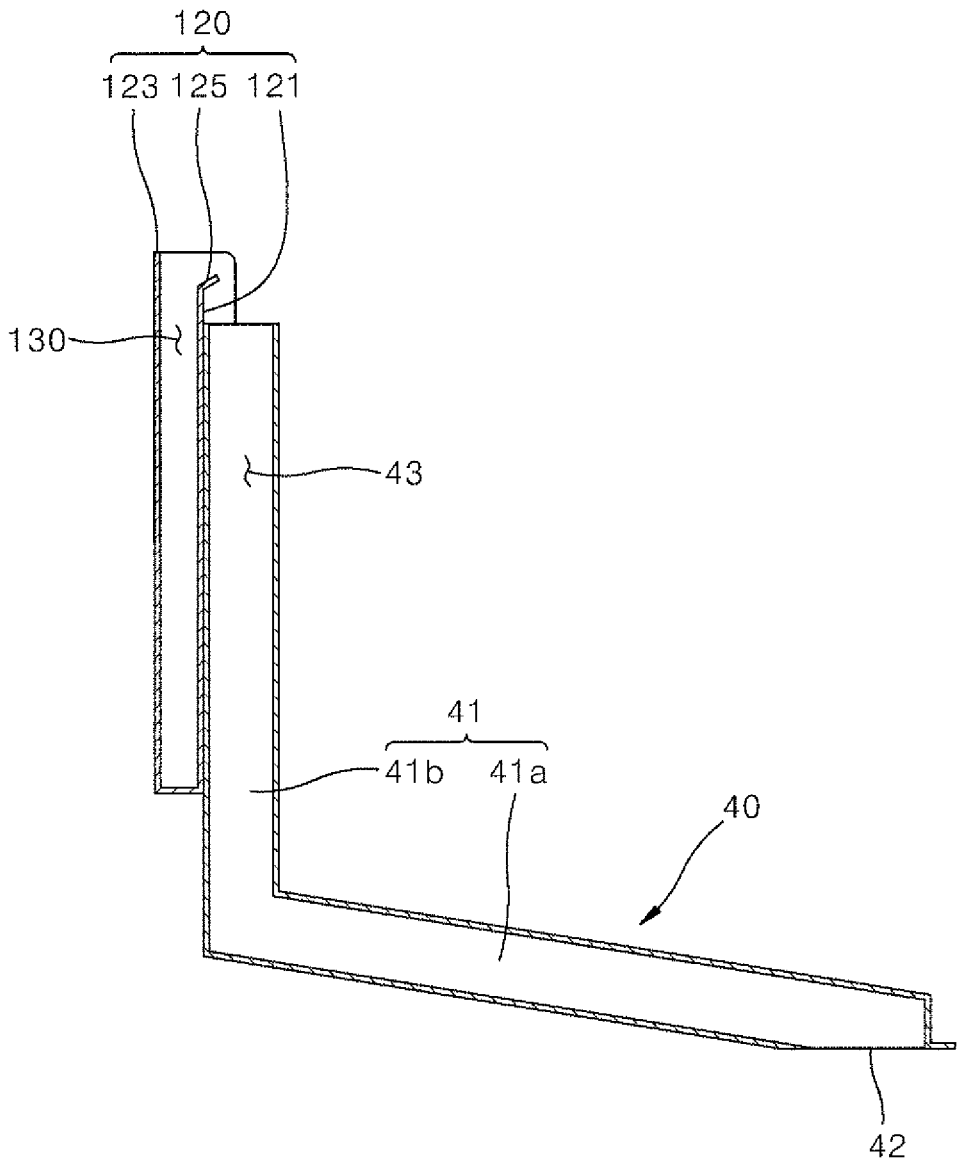

In the second duct unit 120 of the guide duct 100, as illustrated in FIGS. 11 and 12, the third exhaust opening 130 is disposed higher than the first exhaust opening 43 such that cool air discharged through the third exhaust opening 130 is discharged from a position higher than the position from which high-temperature combustion gases are discharged through the first exhaust opening 43.

When cool air is discharged through the third exhaust opening 130 disposed higher than the first exhaust opening 43 through which high-temperature combustion gases are discharged, the rear panel 15 at the rear surface of the cooking appliance may be effectively prevented from being overheated by the high-temperature combustion gases even when speeds at which the cool air is discharged through the third exhaust opening 130 are slower than speeds at which the high-temperature combustion gases are discharged through the first exhaust opening 43.

That is, even when speeds at which the cool air is discharged are slower than speeds at which the high-temperature combustion gases are discharged, the high-temperature combustion gases discharged from a relatively low position is in an area affected by the cool air discharged from a relatively high position because the cool air is discharged from a position higher than the position from which the high-temperature combustion gases are discharged.

Accordingly, the high-temperature combustion gases discharged through the first exhaust opening 43 are necessarily discharged together with the cool air, and the high-temperature of the combustion gases may not be directly conveyed to the rear panel 15 at the rear surface of the cooking appliance.

As a result, the rear panel 15 at the rear surface of the cooking appliance may be prevented from being overheated by the high-temperature combustion gases, and the temperature of the combustion gases discharged through the exhaust vent 25 may be efficiently lowered.

The rear surface portion 123 of the second duct unit 120, which is adjacent to the rear panel 15 at the rear surface of the cooking appliance on the opposite side of the front surface portion 121 of the second duct unit 120 has a height greater than the front surface portion 121, which is adjacent to the exhaust duct 40. Additionally, an inclined surface 125 is provided at the upper end of the front surface portion 121 that is adjacent to the third exhaust opening 130.

The inclined surface 125 is formed in the shape in which the upper end portion of the front surface portion 121 is inclinedly bent toward the exhaust duct 40 and the first exhaust opening 43. The inclined surface 125 guides the flow of cool air discharged through the third exhaust opening 130 such that the cool air is guided further forward. Additionally, the inclined surface 125 may suppress the flow of the high-temperature combustion gases discharged through the first exhaust opening 43 toward the rear surface of the cooking appliance even slightly.

Accordingly, a thick air curtain may be formed at the rear of the exhaust duct 40 because the cool air discharged through the third exhaust opening 130 may spread far from the rear panel 15 and may move upward, thereby preventing the rear surface of the cooking appliance from being overheated.

The above-described cooking appliance of the embodiment may lower discharge temperatures of high-temperature combustion gases discharged through the exhaust duct 40 by attracting the flow of cool air introduced into the cool air-exhaust duct 45 toward the exhaust duct 40, and may effectively prevent safety-related accidents such as a fire, a burn and the like that may be caused due to overheating of the rear panel 15 and due to high-temperature exhaust gases by forming an air curtain of cool air between the exhaust duct 40 and the rear panel 15.

The objective of the present disclosure is to provide a cooking appliance having an improved structure that can lower the temperature of combustion gases of a cooking chamber, which are generated while foods are being cooked and that can discharge the gases.

The objectives are solved by the features of the independent claim. As a means to achieve the above-described objective, the cooking appliance of an embodiment includes a cool air-exhaust duct connected to a space formed between an oven unit and a cooktop heating unit and a guide duct diverged from the cool air-exhaust duct and extended toward the rear of an exhaust duct.

Additionally, the cooking appliance of the same or another embodiment may include a passage for discharging cool air that is disposed between an exhaust duct and a rear panel, and accordingly, an air curtain is formed between the exhaust duct and rear panel.

The cooking appliance according to an embodiment includes; an oven unit that has a cooking chamber therein; a cooktop unit that is disposed in the upper portion of the oven unit and that is provided with at least one cooktop heating unit; an exhaust vent that is disposed at the rear of the cooktop unit; an exhaust duct that forms a passage connecting the cooking chamber and the exhaust vent, therein; a space that is formed between the oven unit and the cooktop heating unit; a cool air-exhaust duct that forms a passage connecting the space and the exhaust vent, therein; and a guide duct that forms a passage diverged from the cool air-exhaust duct and extended toward the rear of the exhaust duct, therein.

The exhaust duct may include at least one of: a first duct body that forms a passage connecting the cooking chamber and the exhaust vent therein, a first inlet that is connected with the oven unit at one end of the first duct body, and a first exhaust opening that opens the other end of the first duct body toward the exhaust vent. The cool air-exhaust duct may include at least one of: a second duct body that forms a passage connecting the space and the exhaust vent therein, a second inlet that opens one end of the second duct body toward the space, a second exhaust opening that opens the other end of the second duct body toward the exhaust vent, and a diverging opening that forms a passage opening the second duct body at a position different from the second inlet and the second exhaust opening.

The cooking appliance may further include a bypass member that is placed inside the second duct body. The bypass member may form a passage, which directs airflow introduced into the second duct body toward the diverging opening, inside the second duct body.

The second inlet may be disposed in the lower portion of the second duct body, and/or the second exhaust opening may be disposed in the upper portion of the second duct body. The second duct body may be disposed in a lateral portion of the first duct body. The diverging opening may be disposed in a lateral portion of the second duct body that faces the first duct body adjacent to the diverging opening. The bypass member may form a passage, wherein the lower portion of the passage is opened toward the first inlet and/or wherein a lateral portion thereof is opened toward the diverging opening.

The bypass member may have a shape in which a width of the lower portion of the bypass member becomes wider as the bypass member is closer to the second inlet.

The guide duct may comprise at least one of: a first duct unit that forms a passage directing flow of air discharged through the diverging opening toward the exhaust duct, therein; a second duct unit that forms a passage directing flow of air flowing into the first duct unit toward first exhaust opening, therein; and a third exhaust opening that opens the second duct unit toward the exhaust vent at a position adjacent to the first exhaust opening.

The first duct unit may be provided between the exhaust duct and the cool air-exhaust duct. The first duct unit form a passage connecting the diverging opening and the second duct unit, therein. The second duct unit may be provided at the rear of the exhaust duct. The second duct unit may form a passage connecting the first duct unit and the exhaust vent at the rear of the exhaust duct, therein.

A rear panel may be provided at the rears of the exhaust duct and the guide duct. The rear panel may be connected to the rears of the oven unit and the cooktop unit. The rear panel may form the rear appearance of the cooking appliance. The second duct unit may be provided at the rear of the exhaust duct such that the third exhaust opening is disposed between the first exhaust opening and the rear panel.

The exhaust duct may include a lower section that is disposed in the space. The lower section may form a passage connected with the cooking chamber, therein. The lower section may be inclined backward and upward in the spaced unit. The exhaust duct may include an upper section that forms a passage connecting the lower section and the exhaust vent, therein, and that extends upward. The second duct unit may be disposed between the upper section and the rear panel.

In the second duct unit, the third exhaust opening may be disposed higher than the first exhaust opening.

A rear surface portion of the second duct unit, which is adjacent to the rear panel, may have a height greater than a front surface portion of the second duct unit, which is adjacent to the exhaust duct.

The second duct unit may be provided with an inclined surface in which the upper end of the front surface portion is inclinedly bent.

The cooking appliance may further include a blowing unit that is provided on the second inlet side and that forms air currents in which air introduced into the space is discharged out of the exhaust vent through the cool air-exhaust duct.

The cooking appliance may further include a control panel that is provided at the front of the cooktop unit and a door that opens and closes the cooking chamber at the front of the oven unit. A cool air passage that communicates between the outside of the cooking appliance and the space may be formed between the door and the control panel. The blowing unit may suction air introduced into the space through the cool air passage and introduces the air into the cool air-exhaust duct.

The space may be an electric chamber in which electric parts are placed.

According to a further embodiment, a cooking appliance comprises an oven unit including a cooking chamber; a cooktop unit on the oven unit and including at least one cooktop heating unit; an exhaust vent for discharging air from the cooking appliance; an electric chamber for accommodating electric parts between the cooking chamber and the cooktop heating unit; an exhaust duct for connecting the cooking chamber to the exhaust vent; a cool air-exhaust duct for connecting the electric chamber to the exhaust vent; and a guide duct branching from the cool air-exhaust duct and extending along the exhaust duct to the exhaust vent. The exhaust duct may have a first inlet at the cooking chamber and a first exhaust opening at the exhaust vent. The cool air-exhaust duct may have a second inlet at the electric chamber and a second exhaust opening at the exhaust vent. The guide duct may have a third exhaust opening at the exhaust vent to discharge air from the cool air-exhaust duct. The cool air-exhaust duct may include a diverging opening connected to the guide duct.

The cooking appliance may further comprise a main body defining an outer appearance of the cooking appliance. The main body may include a rear panel for forming a rear surface of the cooking appliance. The cooking appliance may also include a door at a front surface of the cooking appliance for opening and closing the cooking chamber, the rear surface being opposite to the front surface. The exhaust vent may be disposed at a rear side of the cooking appliance, preferably adjacent to the cooktop unit. For instance, the exhaust vent may be disposed between the cooktop unit and the rear panel. The guide duct may extend in parallel to the exhaust duct, preferably between rear panel and exhaust duct.

The cooking appliance may include a bypass member disposed inside the cool air-exhaust duct for directing some of the airflow flowing inside the cool air-exhaust duct through the diverging opening into the guide duct.

The bypass member may be mounted to a portion of the cool air-exhaust duct adjacent to the diverging opening. The bypass member may form a closed space with said portion, except for a lower portion of the bypass member facing the second inlet and a first lateral portion of the bypass member facing the diverging opening being open for guiding some of the airflow flowing inside the cool air-exhaust duct through the diverging opening. The space formed by the bypass member may partially surround the diverging opening.

The bypass member may include an inclined portion having a lower end facing the second inlet and extending farther into the cool air-exhaust duct than its upper end facing away from the second inlet. The upper end may be positioned adjacent to the diverging opening.

The cool air-exhaust duct may be disposed laterally of the exhaust duct. Preferably, two cool air-exhaust duct are laterally disposed at either side of the exhaust duct. That is, the exhaust duct is disposed between two cool air-exhaust ducts. Each of the cool air-exhaust ducts may include a second exhaust opening (48) arranged along a line with the first exhaust opening (43) in between.

The guide duct may comprise a first duct unit connected to the cool air-exhaust duct and a second duct unit being connected to the first duct unit and extending to the exhaust vent, i.e. connecting the first duct unit to the exhaust vent. The cooking appliance may comprise a rear panel forming a rear surface of the cooking appliance. The second duct unit may be disposed between the exhaust duct and the rear panel. The second duct unit may include a third exhaust opening that opens the second duct unit toward the exhaust vent. The third exhaust opening may be disposed between the first exhaust opening of the exhaust duct and the rear panel.

The second guide unit may be in contact with the exhaust duct for heat-exchange.

The third exhaust opening may be closer to the exhaust vent than the first exhaust opening.

A rear surface portion of the second duct unit, which is adjacent to the rear panel, may extend closer to the exhaust vent than a front surface portion of the second duct unit, which is adjacent to the exhaust duct.

The second duct unit may be provided with an inclined surface at the upper end of the front surface portion which is inclined toward the exhaust duct.

The cool air-exhaust duct may further include a blowing unit for discharging air in the electric chamber through the exhaust vent.

A cool air passage may communicate between the outside of the cooking appliance and the electric chamber, i.e. connect the electric chamber to an outside of the cooking appliance.

A blowing unit may be provided in the cool air-exhaust duct, the blowing unit being configured to suction air into the electric chamber through the cool air passage and/or to discharge air in the electric chamber via the cool air-exhaust duct through the exhaust vent.

The cooking appliance may include at least one of a main body defining an outer appearance of the cooking appliance; a control panel at a front side or front surface of the cooking appliance, and a door for opening and closing the cooking chamber at a front side or front surface of the cooking appliance.

According to the present disclosure, the cooking appliance may lower discharge temperatures of high-temperature combustion gases discharged through the exhaust duct by attracting the flow of cool air introduced into the cool air-exhaust duct toward the exhaust duct, and may effectively prevent safety-related accidents such as a fire, a burn and the like that may be caused due to overheating of the rear panel and due to high-temperature exhaust gases by providing an air curtain of cool air between the high-temperature combustion gases discharged through the exhaust duct and the rear panel.

Preferably, the cooking appliance further includes a bypass member placed inside a second duct body and forming a passage, which leads the flow of air introduced into the second duct body to a diverging opening side, in the second duct body.

Accordingly, the cooking appliance may provide a structure in which the flow of cool air introduced into the cool air-exhaust duct is diverged toward the exhaust duct through the guide duct.

Preferably, a rear panel connected to the rears of the oven unit and the cooktop unit and forming the rear appearance of the cooking appliance is provided at the rears of the exhaust duct and the guide duct, and the second duct unit is provided at the rear of the exhaust duct such that a third exhaust opening and a first exhaust opening are disposed between the rear panel.

With the structure in which the guide duct is disposed, the position from which cool air is discharged is closer to the rear panel than to the position from which high-temperature combustion gases are discharged, thereby preventing the overheating of the rear panel.

Preferably, in the second duct unit, the third exhaust opening is disposed higher than the first exhaust opening.

With the structure in which the second duct unit is disposed, the overheating of the rear panel on the rear surface of the cooking appliance, which is caused by high-temperature combustion gases, may be prevented even when the speeds at which cool air is discharged are slower than the speeds at which high-temperature combustion gases are discharged.

The cooking appliance according to the present disclosure may lower discharge temperatures of high-temperature combustion gases discharged through the exhaust duct by attracting the flow of cool air introduced into the cool air-exhaust duct toward the exhaust duct, and may effectively prevent safety-related accidents such as a fire, a burn and the like that may be caused due to overheating of the rear panel and due to high-temperature exhaust gases by providing an air curtain of cool air between the high-temperature combustion gases discharged through the exhaust duct and the rear panel.

The present disclosure has been described with reference to the embodiments illustrated in the drawings. However, the embodiments are provided only as examples. It will be apparent to one having ordinary skill in the art that the embodiments are intended to cover various modifications and equivalents of the disclosure. Thus, the technical scope of the present disclosure should be defined by the appended claims.

DESCRIPTION OF THE SYMBOLS

10: Main body
20: Cooktop unit
23: Cooktop heating unit
25: Exhaust vent
30: Oven unit
31: Cooking chamber
32: Door
40: Exhaust duct
41: First duct body
42: First inlet
43: First exhaust opening
45: Cool air-exhaust duct
46: Second duct body
46*a*: Front member
46*b*: Rear member
47: Second inlet
48: Second exhaust opening
49: Diverging opening
50: Electric chamber
51: Control panel
52: Input unit
53: Display unit
60: Blowing unit
70: Bypass member
100: Guide duct
110: First duct unit
120: Second duct unit
121: Front surface portion
123: Rear surface portion
125: Inclined surface
130: Third exhaust opening

What is claimed is:

1. A cooking appliance, comprising:
an oven having a cooking chamber;
a cooktop disposed at an upper portion of the oven and provided with at least one cooktop heating unit;
an exhaust vent disposed at a rear of the cooktop;
an exhaust duct that forms a passage that connects the cooking chamber and the exhaust vent;
a space formed between the oven and the at least one cooktop heating unit;
a cool air-exhaust duct that forms a passage that connects the space and the exhaust vent; and
a guide duct that forms a passage diverged from the cool air-exhaust duct and extended toward a rear of the exhaust duct, wherein the exhaust duct includes:
a first duct body that forms a passage that connects the cooking chamber and the exhaust vent;
a first inlet connected with the oven at a first end of the first duct body; and
a first exhaust opening at a second end of the first duct body that opens toward the exhaust vent, wherein the cool air-exhaust duct includes:
a second duct body that forms a passage that connects the space and the exhaust vent;
a second inlet at a first end of the second duct body that opens toward the space;
a second exhaust opening that opens a second end of the second duct body toward the exhaust vent;
a diverging opening that forms a passage opening in the second duct body at a position different from the second inlet and the second exhaust opening; and
a bypass member located inside of the second duct body and forming a passage that directs airflow introduced into the second duct body toward the diverging opening, wherein the second inlet and the second exhaust opening are respectively disposed at a lower portion and an upper portion of the second duct body, wherein the second duct body is disposed at a lateral portion of the first duct body, the diverging opening s disposed at a lateral portion of the second duct body that faces the first duct body, the bypass member forms a passage a lower portion of which is opened toward the second inlet and a lateral portion of which is opened toward the diverging opening.

2. The cooking appliance of claim 1, wherein the bypass member has a shape in which a width of the lower portion of the bypass member increases in width as the bypass member extends closer to the second inlet.

3. A cooking appliance, comprising:
an oven having a cooking chamber;
a cooktop disposed at an upper portion of the oven and provided with at least one cooktop heating unit;
an exhaust vent disposed at a rear of the cooktop;
an exhaust duct that forms a passage that connects the cooking chamber and the exhaust vent;
a space formed between the oven and the at least one cooktop heating unit;
a cool air-exhaust duct that forms a passage that connects the space and the exhaust vent;
a guide duct that forms a passage diverged from the cool air-exhaust duct and extended toward a rear of the exhaust duct; and
a cabinet connected to a rear of the oven and the cooktop and that forms a rear appearance of the cooking appliance provided at a rear of the exhaust duct and the guide duct, wherein the exhaust duct includes:
a first duct body that forms a passage that connects the cooking chamber and the exhaust vent;
a first inlet connected with the oven at a first end of the first duct body; and
a first exhaust opening at a second end of the first duct body that opens toward the exhaust vent, wherein the cool air-exhaust duct includes:
a second duct body that forms a passage that connects the space and the exhaust vent;
a second inlet at a first end of the second duct body that opens toward the space;
a second exhaust opening that opens a second end of the second duct body toward the exhaust vent; and
a diverging opening that forms a passage opening in the second duct body at a position different from the second inlet and the second exhaust opening, wherein the guide duct comprises:

a first duct that forms a passage that directs a flow of air discharged through the diverging opening toward the exhaust duct;

a second duct forms a passage that directs a flow of air flowing into the first duct toward first exhaust opening; and a third exhaust opening that opens toward the exhaust vent at a position adjacent to the first exhaust opening, wherein the second duct is provided at the rear of the exhaust duct such that the third exhaust opening is disposed between the first exhaust opening and the cabinet, wherein the exhaust duct includes:

a lower section disposed in the space and forming a passage connected with the cooking chamber inclined rearward and upward in the space; and an upper section that forms a passage that connects the lower section and the exhaust vent and that extends upward, wherein the second duct is disposed between the upper section and the cabinet.

4. The cooking appliance of claim 3, wherein the first duct is provided between the exhaust duct and the cool air-exhaust duct and forms a passage that connects the diverging opening and the second duct, and wherein the second duct is provided at a rear of the exhaust duct and forms a passage that connects the first duct and the exhaust vent at the rear of the exhaust duct.

5. A cooking appliance, comprising:

an oven having a cooking chamber;

a cooktop disposed at an upper portion of the oven and provided with at least one cooktop heating unit;

an exhaust vent disposed at a rear of the cooktop;

an exhaust duct that forms a passage that connects the cooking chamber and the exhaust vent;

a space formed between the oven and the at least one cooktop heating unit;

a cool air-exhaust duct that forms a passage that connects the space and the exhaust vent;

a guide duct that forms a passage diverged from the cool air-exhaust duct and extended toward a rear of the exhaust duct; and a cabinet connected to a rear of the oven and the cooktop and that forms a rear appearance of the cooking appliance provided at a rear of the exhaust duct and the guide duct, wherein the exhaust duct includes:

a first duct body that forms a passage that connects the cooking chamber and the exhaust vent;

a first inlet connected with the oven at a first end of the first duct body; and a first exhaust opening at a second end of the first duct body that opens toward the exhaust vent, wherein the cool air-exhaust duct includes:

a second duct body that forms a passage that connects the space and the exhaust vent;

a second inlet at a first end of the second duct body that opens toward the space;

a second exhaust opening that opens a second end of the second duct body toward the exhaust vent; and a diverging opening that forms a passage opening in the second duct body at a position different from the second inlet and the second exhaust opening, wherein the guide duct comprises:

a first duct that forms a passage that directs a flow of air discharged through the diverging opening toward the exhaust duct;

a second duct forms a passage that directs a flow of air flowing into the first duct toward first exhaust opening; and a third exhaust opening that opens toward the exhaust vent at a position adjacent to the first exhaust opening, and wherein in the second duct, the third exhaust opening is disposed higher than the first exhaust opening.

6. The cooking appliance of claim 5, wherein a rear surface of the second duct, which is adjacent to the cabinet, has a height greater than a front surface of the second duct, which is adjacent to the exhaust duct.

7. The cooking appliance of claim 6, wherein the second duct is provided with an inclined surface in which an upper end of the front surface is bent forward at an incline.

8. The cooking appliance of claim 1, wherein the cooking appliance further includes:

a blowing unit provided at a side of the second inlet and that forms air currents in which air introduced into the space is discharged out of the exhaust vent through the cool air-exhaust duct.

9. The cooking appliance of claim 8, wherein the cooking appliance further includes:

a control panel provided at a front of the cooktop;

a door that opens and closes the cooking chamber at a front of the oven;

a cool air passage formed between the door and the control panel that communicates between an outside of the cooking appliance and the space, wherein the blowing unit suctions air introduced into the space through the cool air passage and introduces the air into the cool air-exhaust duct.

10. The cooking appliance of claim 1, wherein the space is an electric chamber in which electric components are placed.

* * * * *